US011697044B2

(12) United States Patent
Harker

(10) Patent No.: US 11,697,044 B2
(45) Date of Patent: Jul. 11, 2023

(54) GROUP EXERCISE DEVICE

(71) Applicant: Shon L Harker, Clearfield, UT (US)

(72) Inventor: Shon L Harker, Clearfield, UT (US)

( * ) Notice: Subject to any disclaimer, the term of this patent is extended or adjusted under 35 U.S.C. 154(b) by 0 days.

(21) Appl. No.: 16/801,433

(22) Filed: Feb. 26, 2020

(65) Prior Publication Data

US 2020/0269081 A1 Aug. 27, 2020

Related U.S. Application Data

(60) Provisional application No. 62/811,047, filed on Feb. 27, 2019.

(51) Int. Cl.
*A63B 21/16* (2006.01)
*A63B 21/00* (2006.01)
*A63B 21/055* (2006.01)

(52) U.S. Cl.
CPC ..... *A63B 21/16* (2013.01); *A63B 21/00047* (2013.01); *A63B 21/0552* (2013.01)

(58) Field of Classification Search
CPC ..... A63B 21/16; A63B 21/00047; A63B 21/0552; A63B 2225/10; A63B 71/0054; A63B 2225/093; A63B 2071/026
See application file for complete search history.

(56) References Cited

U.S. PATENT DOCUMENTS 4,258,915 A 3/1981 Sellge
4,729,561 A * 3/1988 Desjardins ..... A63B 21/078 482/104
5,082,260 A * 1/1992 Dinelli ..... A63B 21/078 482/104
5,501,647 A 3/1996 Snyder
5,792,032 A * 8/1998 Williams ..... A63B 69/34 482/90
6,203,473 B1 3/2001 Atwood
6,245,001 B1 * 6/2001 Siaperas ..... A63B 21/0552 482/142
D487,124 S 2/2004 Toniolo
6,743,152 B2 6/2004 Weiss
7,169,094 B2 1/2007 Ardito
7,476,183 B1 * 1/2009 Chrest ..... A63B 23/12 482/93
7,608,029 B2 10/2009 Weiss
(Continued)

FOREIGN PATENT DOCUMENTS

GB 9733657 9/1997

*Primary Examiner* — Andrew S Lo
*Assistant Examiner* — Andrew M Kobylarz
(74) *Attorney, Agent, or Firm* — Legends Law Group, PLLC; Stephen H. Bean, Esq.

(57) ABSTRACT

A group exercise device is provided. The device has a top where a person exercising can obtain balance and positional support during the exercise routine. In addition, the exercise device provides different points of attachment for exercise units. The attachment points vary in vertical placement measured from the floor such that individuals of different builds and heights can jointly use the unit during either solo or group routines. The exercise device of the present invention promotes group interaction during an exercise routine by providing a stable attachment point for multiple users of exercise units, such as resistance bands, and a balance bar accessible in a communal fashion.

11 Claims, 4 Drawing Sheets

(56) References Cited

U.S. PATENT DOCUMENTS

| | | | | |
|---|---|---|---|---|
| 7,798,920 | B1 * | 9/2010 | Cortes | A63B 67/00 482/14 |
| 7,896,786 | B1 | 3/2011 | Osbourne | |
| RE43,167 | E | 2/2012 | Horvath | |
| 8,267,840 | B2 | 9/2012 | Barnes | |
| 8,425,383 | B1 | 4/2013 | Kelly | |
| 9,174,080 | B2 | 11/2015 | Harker | |
| 9,199,119 | B2 | 12/2015 | Hetrick | |
| 9,295,866 | B2 | 3/2016 | Kwo | |
| 2002/0160891 | A1 | 10/2002 | Gallagher | |
| 2008/0234117 | A1 | 9/2008 | Clark | |
| 2010/0167887 | A1 | 6/2010 | Berry | |
| 2010/0267522 | A1 | 10/2010 | Penney | |
| 2012/0094788 | A1 * | 4/2012 | Hartigan | A63B 69/002 473/445 |
| 2012/0094815 | A1 | 4/2012 | Trettin | |
| 2012/0142506 | A1 | 6/2012 | Hetrick | |
| 2013/0172160 | A1 * | 7/2013 | Poole | A63B 23/0458 482/129 |
| 2013/0337983 | A1 | 12/2013 | McTavish | |
| 2013/0345026 | A1 | 12/2013 | Eberflus | |
| 2015/0011365 | A1 * | 1/2015 | Nelson | A63B 21/06 482/84 |
| 2015/0141218 | A1 | 5/2015 | Magrella | |
| 2015/0237394 | A1 | 8/2015 | Haykinson et al. | |
| 2016/0136472 | A1 | 5/2016 | Kwo | |
| 2016/0256725 | A1 * | 9/2016 | Verdi | A63B 21/153 |
| 2017/0065845 | A1 * | 3/2017 | Pinkus | A63B 21/4035 |
| 2018/0015346 | A1 * | 1/2018 | Gilman | A63B 69/345 |
| 2018/0140885 | A1 * | 5/2018 | Antunez | A63B 21/0601 |
| 2019/0009126 | A1 * | 1/2019 | Davison | A63B 21/4043 |
| 2019/0015697 | A1 * | 1/2019 | Yarvitz | A63B 21/4043 |
| 2019/0118022 | A1 * | 4/2019 | Carter | A63B 21/0087 |
| 2020/0070029 | A1 * | 3/2020 | Creech | A63B 69/345 |
| 2020/0139182 | A1 * | 5/2020 | Price | A63B 21/068 |
| 2021/0023432 | A1 * | 1/2021 | Heppner | A63B 69/345 |
| 2021/0086014 | A1 * | 3/2021 | Sharp | A63B 21/151 |
| 2021/0086019 | A1 * | 3/2021 | Hairston | A63B 22/20 |
| 2021/0121726 | A1 * | 4/2021 | Potapov | A63B 21/4037 |

* cited by examiner

GROUP EXERCISE DEVICE

FIELD OF THE INVENTION

The present invention relates to a group exercise device. The device is useful to both individual exercise enthusiasts and also to groups of two or more exercisers who wish to engage in joint exercise routines. The device is designed for easy movement between different locations within the same room or exercise facility. Further, the device is simple to assemble and disassemble, making it easy to move up and down stairs or to transport greater distances. The invention described herein is useful in home gyms, commercial gyms, dance studios, collegiate sports facilities, professional sports facilities, and the like. The field of the invention encompasses but is not limited to athletic training equipment, personal exercise equipment, and equipment for dance and ballet studios.

BACKGROUND OF THE INVENTION

It is quite common for people engaged in dance, ballet, barre exercises, Pilates® exercises, and general fitness movements requiring position and strength to use a bar or railing for maintaining balance. In addition to helping a person to keep balanced, a bar or railing also provides a place for a person to perform elevated stretches of a leg or arm. The bar or railing also provides a point for rest or relaxation between exercise routines.

Traditionally, the exercise bar or railing is installed on the wall around the edge of a room. There are distinct disadvantages to this arrangement. First, only the edges of the room are utilized while the middle of the room remains empty. This arrangement limits the number of persons exercising to less than the maximum occupancy of the room. Second, limiting persons who are exercising to the edges of the room and in a direction facing generally away from the middle of the room inhibits the ability of the exercisers to engage in natural, group interactions during the exercise routine. It also makes it difficult for an instructor to meaningfully engage with the group during the routine.

One way to overcome some of the limitations of the traditional installation is to provide mirrors on the walls of the room. This aides in the instructor being seen by the persons exercising but this does not increase the number of exercisers in the room and it is expensive. Another way to overcome the prior art limitations is to build permanent bars in the middle of the room. However, this decreases the overall utility of the exercise facility and limits additional recreational uses of the room. Some have tried to overcome these limitations by using portable t-shaped bars but these devices are flimsy and do not promote group interactions.

There exists a need for an exercise device that offers bar-like balance and position assistance while concomitantly promoting group interactions during the exercise routine. There further exists a need for an exercise device that is easily moveable such that an entire room can be quickly staged with the exercise devices and then un-staged after the routines are finished, thus allowing the exercise routines to be performed in general purpose rooms. In addition, there exists a need for an exercise device that is stable during both individual and group routines. There also exists a need for an exercise device that provides varied points of attachment for resistance bands to be used by one or more individuals during either solo or group exercise routines, the device being stable and solid.

SUMMARY OF THE INVENTION

The present invention relates to a group exercise device. In particular, the invention relates to a moveable exercise unit that has a top bar where a person exercising can obtain balance and positional support during the exercise routine. In addition, the exercise device provides different points of attachment for resistance bands. The attachment points vary in vertical placement measured from the floor such that individuals of different builds and heights can jointly use the unit during either solo or group routines. The device is inherently stable and can be further stabilized by securing plate weights within the unit. The exercise device of the present invention is designed to promote group interaction during an exercise routine by providing a stable attachment point for multiple users of resistance bands and a balance bar accessible in a communal fashion.

Figure 1:
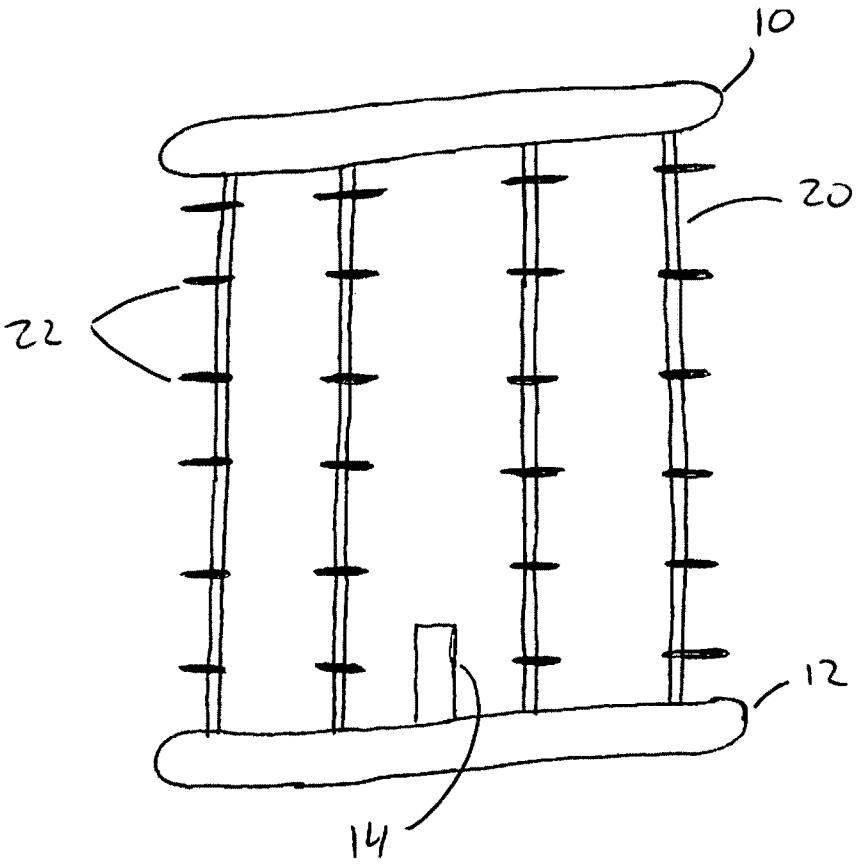
FIG. 1 illustrates a side view of the group exercise device of the present invention.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity.

DETAILED DESCRIPTION OF THE INVENTION

Reference will now be made in detail to the presently preferred embodiments of the invention. There are also representative examples of the invention illustrated in the accompanying drawings. Throughout the following detailed description, the same reference numeral refers to the same elements in all figures.

Figure 2:
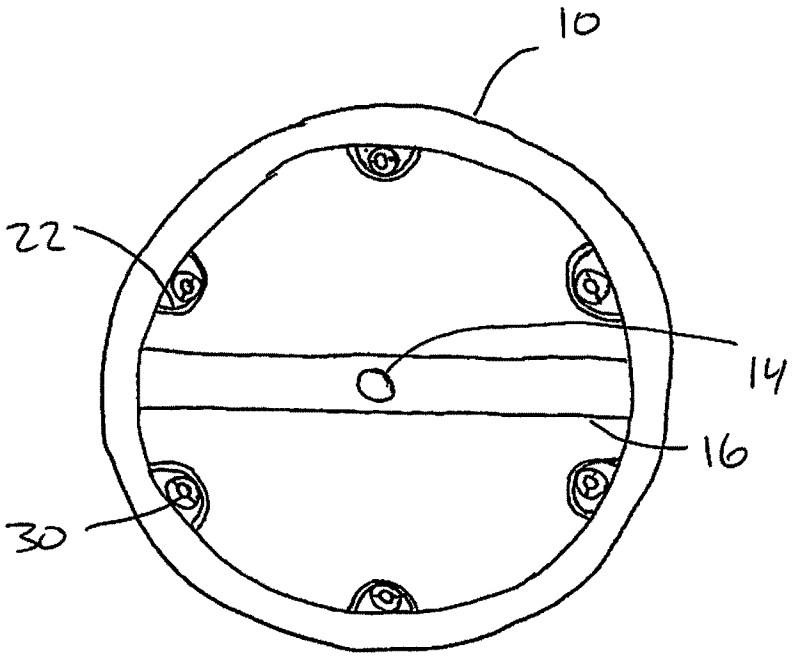
FIG. 2 illustrates a top view of the group exercise device of the present invention.
Figure 3:
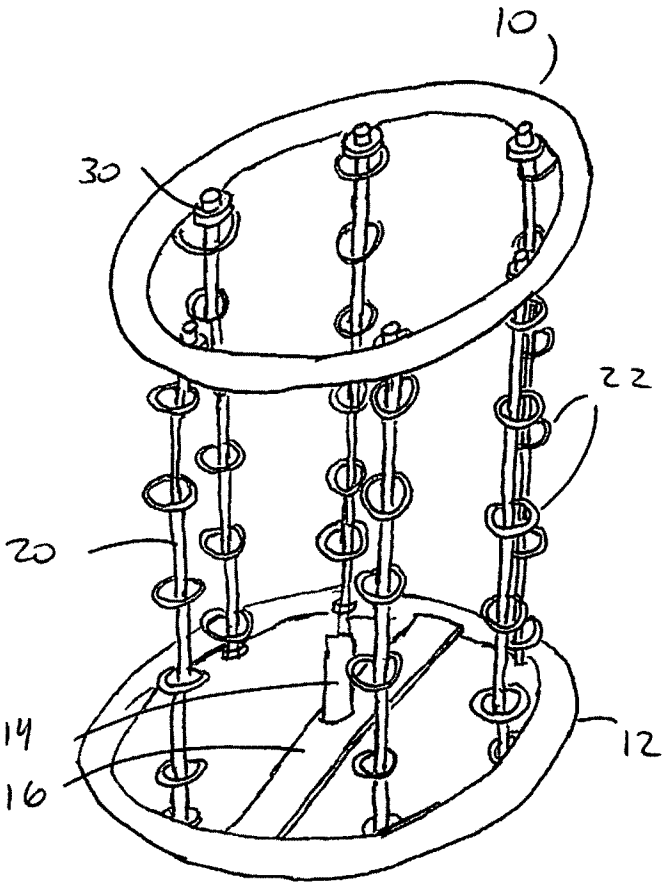
FIG. 3 illustrates a top perspective view of the group exercise device of the present invention.

The present invention provides a group exercise device. In one embodiment of the invention (referring to FIGS. 1-3), there is a top piece (10) and bottom piece (12) connected by a plurality of spines (20). Top piece (10) and bottom piece (12) can be formed from any solid material that will provide rigidity and strength. Preferably, these pieces are formed of tubular steel, as that avoids edges that might be uncomfortable to a user that is resting an arm or leg on top piece (10) during or between exercise routines. In one embodiment of the invention, top piece (10) and bottom piece (12) are formed as matching circles. The advantage of circle-shaped top and bottom pieces is that the exercise unit can be easily tipped, either partially or completely onto its side, and rolled from one location another.

However, the present invention also contemplates opposing top and bottom pieces of both matching and non-matching shapes. For example, top piece (10) and bottom piece (20) could be formed of multi-sided polygonal shapes such as squares, hexagons, octagons, and even higher count sides. In addition, bottom piece (12) could be formed as a circle, which aides in easy movement of the device, while top piece (10) could be formed as an octagon or the like. In this configuration, the bottom piece could be easily rolled while the top piece would have more defined segments, which may or may not correspond to spines (20), for user participation.

According to one embodiment of the present invention, an anchor post (14) and post brace (16) are provided integral to bottom piece (12). During fabrication, these pieces could be welded together. Bottom piece (12), post brace (16), and anchor post (14) could also be formed of a single, solid piece of formed metal or high-density reinforced or non-reinforced plastic. Anchor post (14) is sized to receive one or more standard plate weights (not shown) that can be used to weigh down the exercise device during use. There may also be a locking hinge arm on the top of anchor post (14) that is moveable between an unlocked and a locked position. With the locking hinge arm, plate weights can be slid onto anchor post (14) and then locked into place such that the weights do not slide off of anchor post (14) if the exercise unit is tipped or positioned onto its side and rolled or otherwise moved to a different location. Other safety arranges would also work, such as providing for a lockable cap for threading onto the top of anchor post (14) or a slot-and-pin arrangement wherein a pin is securely positioned through anchor post (14) to prevent unwanted spilling of the plate weights during movement.

According to the present invention, there are a plurality of spines (20) interspaced between top piece (10) and bottom piece (12). To ensure that top piece (10) is horizontal, it is preferred that spines (20) be of the same height. A plurality of attachment points (22) may be placed along the lengths of spines (20) and serve as locations for connecting resistance training devices. One common type of resistance training devices are the SLASTIX® brand sheathed elastics, which are well-known for their ease of use, versatile tensile strengths, rugged construction, and safety features. In one embodiment of the present invention, attachment points (22) are annular rings affixed to spines (20). The annular rings provide easy points of slideable attachment wherein a resistance band can be attached to the ring and then be pulled in different directions without catching on inner edges or sides that would otherwise be found in non-annular configurations.

Figure 5:
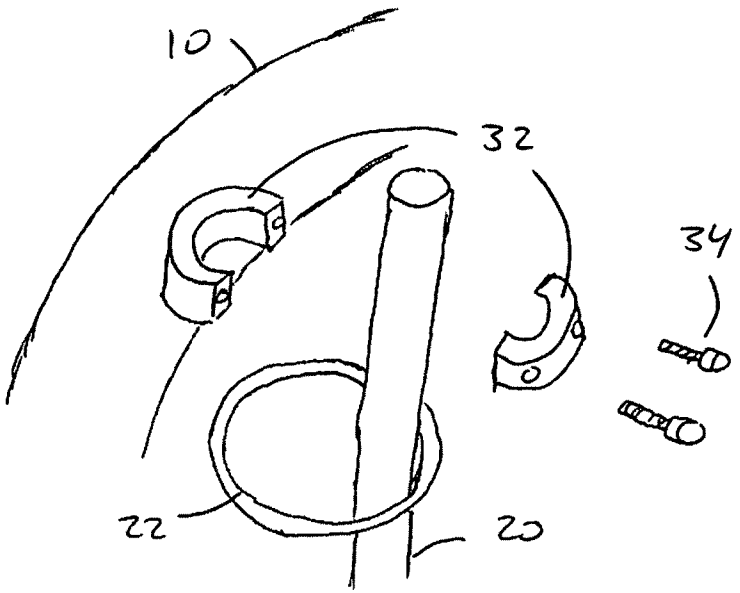
FIG. 5 illustrates an exploded top perspective view of a single spine and clamp joint of the group exercise device of the present invention.
Figure 4:
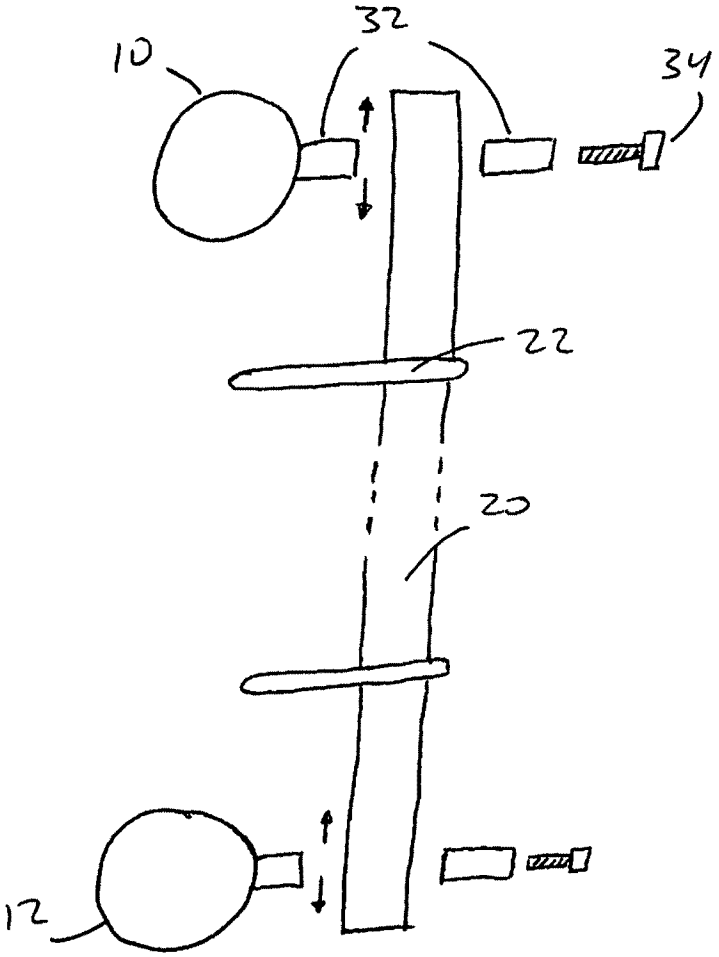
FIG. 4 illustrates an exploded side view of a single spine of the group exercise device of the present invention.

Spines (20) are securely connected to top piece (10) and bottom piece (20) such that the entire device, when assembled, has a caged feature such that plate weights are located within the inside of the device. Spines (20) can be either permanently welded between opposing top and bottom pieces or they can be releasably secured to the same. In the latter configuration (referring to FIGS. 4-5), a feature contemplated in yet another embodiment of the present invention, there is a clamp joint (30) that is used to affix spines (20) to top piece (10) and bottom piece (12). Clamp joint (30) comprises two opposing c-shaped pieces configured to receive locking screws (34). With one side of clamp joint (30) welded to the top or bottom piece, a spine (20) can be secured in place using screws (34) and the other side of the clamp joint. In another embodiment of the invention, ridges or grooves are provided in either an upper portion, a lower portion, or both portions of spines (20) such that the ridges or grooves prevent vertical slippage of the spines during use of the group exercise device. In addition, spines (20) can be provided in a variety of lengths, depending on the user's preference. Further, spines (20) can be formed with telescoping features such that the overall height of top piece (10) can be adjusted through simple adjustment of each individual spine.

In one embodiment of the present invention, attachment points (22) are sized so that they do not protrude beyond the outer edge of top piece (10) or bottom piece (12). This additional design feature ensures that the group exercise device can be smoothly rolled from one location to another.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A group exercise device comprising:

a circular base and circular top having a plurality of spines arranged therebetween, together forming a semi-closed cylindrical structure around a central axis;

wherein each said spine has at least two points of attachment, each point of attachment comprising an aperture that is aligned through a vertical axis extending through the apertures of the at least two points of attachment, the at least two points of attachment facing outward said semi-closed structure configured for connecting an individual exercise unit at variable vertical heights and supporting motion of said individual exercise unit outward said central axis, and wherein said base is weighted to prevent movement of said exercise device during an exercise routine.

2. The group exercise device of claim 1, wherein said top and bottom are formed of a tubular material.

3. The group exercise device of claim 2 wherein said points of attachment are annular rings.

4. The group exercise device of claim 3 wherein said annular rings are configured to not extend beyond the outermost surface of said base and said top.

5. The group exercise device of claim 1 wherein said spines are telescoping.

6. A group exercise device comprising:

a circular base comprising an anchor post;

a circular top; and a plurality of spines arranged between said base and said top, said base, top, and plurality of spines together forming a semi-closed structure around a central axis;

wherein each said spine has at least two points of attachment, each point of attachment comprising an aperture that is aligned through a vertical axis extending through the apertures of the at least two points of attachment, the at least two points of attachment facing outward said semi-closed structure configured for connecting an individual exercise unit at variable vertical heights and supporting motion of said individual exercise unit outward said central axis, and said anchor post is configured to removably accept plate weights to prevent movement of said exercise device during an exercise routine.

7. The group exercise device of claim 6 wherein said anchor post further comprises a locking mechanism to secure said plate weights onto said post.

8. The group exercise device of claim 7 wherein said base and top are formed of a tubular material.

9. The group exercise device of claim 8 wherein said points of attachment are annular rings.

10. The group exercise device of claim 9 wherein said annular rings are configured to not extend beyond the outermost surface of said base and said top.

11. The group exercise device of claim 6 wherein said spines are telescoping.

* * * * *